US006746994B2

(12) United States Patent
Harper

(10) Patent No.: US 6,746,994 B2
(45) Date of Patent: Jun. 8, 2004

(54) OPTIMIZING AN ADVANCED SOLVENT FOR INK SYSTEMS (OASIS)

(75) Inventor: Kit L Harper, Camas, WA (US)

(73) Assignee: Hewlett-Packard Development, L.P., Houston, TX (US)

( * ) Notice: Subject to any disclaimer, the term of this patent is extended or adjusted under 35 U.S.C. 154(b) by 141 days.

(21) Appl. No.: 09/999,568

(22) Filed: Oct. 31, 2001

(65) Prior Publication Data

US 2003/0100458 A1 May 29, 2003

(51) Int. Cl.[7] ..... C11D 9/00
(52) U.S. Cl. ..... 510/170; 510/505; 510/174
(58) Field of Search ..... 510/170, 174, 510/505, 177, 175, 508, 178, 409, 417, 407; 424/65, 401, 59; 134/40, 42, 3, 31, 2, 41

(56) References Cited

U.S. PATENT DOCUMENTS 5,500,659 A 3/1996 Curran, Jr. et al.
5,772,746 A 6/1998 Sawada et al.
5,905,514 A 5/1999 Rhoads et al.
5,907,335 A 5/1999 Johnson et al.
5,914,734 A 6/1999 Rotering et al.
5,917,512 A 6/1999 Weber et al.
5,969,731 A 10/1999 Michael et al.
6,193,352 B1 2/2001 Sharma et al.
6,224,185 B1 5/2001 Fassler et al.
6,455,479 B1 * 9/2002 Sahbari

FOREIGN PATENT DOCUMENTS

EP 0 992 354 A2 12/2000
EP 0 992 355 A2 12/2000

* cited by examiner

*Primary Examiner*—Gregory Webb

(57) ABSTRACT

A cleaning solvent for use with an ink-jet printer, in particular an ink-jet printer having a printhead servicing system, wherein the cleaning solvent comprises glycerin and a polyhydric alcohol, such as 1,3-propanediol. The cleaning solvent is optimized for efficient printhead cleaning regardless of the printer operating environment. A method for cleaning an ink-jet printhead comprises transferring an amount of a cleaning solvent comprising glycerin and a polyhydric alcohol to a printhead surface and cleaning the printhead.

20 Claims, 1 Drawing Sheet

Ascending fluid height in Newton material reservoirs

OPTIMIZING AN ADVANCED SOLVENT FOR INK SYSTEMS (OASIS)

FIELD OF THE INVENTION

The present invention generally relates to ink-jet printing, and in particular, to a cleaning solvent to assist in cleaning the printhead of an ink-jet printer.

BACKGROUND OF THE INVENTION

Ink-jet printing is a non-impact printing process in which droplets of ink are deposited on a print medium. The ink is ejected from a plurality of small nozzles located on the printhead.

During printing, stray ink, dust, and debris can accumulate on the printhead and obstruct or interfere with the proper ejection of ink. In addition, during periods of inactivity, ink can dry on the printhead thereby plugging or blocking the nozzles. Printhead servicing, including wiping the printhead with a cleaning solvent, minimizes the impact of these problems on print quality. To maintain print quality, the printhead must be routinely cleaned.

Ink-jet printers generally have printhead servicing systems to facilitate printhead cleaning. Typical printhead servicing systems employing a wet-wiping method, such as those described in U.S. Pat. No. 5,914,734, usually function by wiping the printhead with a wiper that is associated with the cleaning solvent. Generally, the wiper serves to transfer the cleaning solvent to the printhead and wipe debris from the printhead. However, the cleaning solvent may also be transferred to the printhead independent of the wiper, as described in U.S. Pat. No. 5,907,335.

A cleaning solvent serves numerous functions. First, the cleaning solvent lubricates the wiper, providing better wiping function. Second, the cleaning solvent dissolves some of the dried ink accumulated on the printhead. Third, the cleaning solvent helps the wiper to transport debris off the printhead. Finally, as a thin layer of cleaning solvent is left on the printhead, the cleaning solvent also functions as a protective coating on the printhead making subsequently deposited stray ink or debris easier to wipe off.

Variations of some properties in a cleaning solvent, including viscosity, vapor pressure, solubility, hygroscopicity, and surface tension, affect the performance of the cleaning solvent. Various cleaning solvents, consisting of relatively viscous non-volatile liquids (such as polyethylene glycol (PEG)) or consisting of various compounds dissolved or dispersed in water, are known. For example, U.S. Pat. No. 5,905,514, issued to Rhoads et al., describes a PEG-based cleaning solvent using PEG of molecular weight between 200 and 400. U.S. Pat. No. 6,224,185, issued to Fassler et al., describes a cleaning solvent consisting of a dihydrosilane or trihydrosilane in water. U.S. Pat. No. 6,193,352, issued to Sharma et al., describes a cleaning solvent consisting of an aqueous solvent of a metal salt of a taurine surfactant. U.S. Pat. No. 5,917,512, issued to Weber et al., discloses a cleaning solvent primarily composed of water and ethylene glycol.

Known cleaning solvents demonstrate fluctuations in performance depending on the printer's operating environment. For example, a solvent that performs well in a cold, dry environment may be inefficient in a hot, humid environment. In addition, incompatibility between the ingredients of the cleaning solvent and the ingredients of the structure of the printhead and ink-jet ink are frequently known to occur.

These incompatibilities lead to clumping and blockage of the printhead nozzles and thereby degrade the printhead.

In view of the shortcomings in the art, there remains a need for a cleaning solvent that will not degrade the printhead, does not interact with the ink ingredients, and exhibits exceptional performance regardless of environmental conditions.

BRIEF SUMMARY OF THE INVENTION

In accordance with the present invention, cleaning solvents suitable for use in ink-jet printhead servicing systems and methods for formulating the same are provided. A specific cleaning solvent comprising glycerin and a polyhydric alcohol, such as 1,3-propanediol, is disclosed.

Glycerin has high water retention, a desired characteristic of a printhead cleaning solvent, but is quite viscous. Since the viscosity of glycerin is tempered by absorption of ambient water from the air, glycerin functions adequately as a cleaning solvent in humid conditions. However, in dryer environments, glycerin becomes viscous, which requires applying a larger amount of glycerin to the printhead for adequate cleaning. In addition, minor changes in temperature can significantly affect the viscosity of glycerol. However, the addition of a structurally similar compound, such as 1,3-propanediol, has been found to decrease viscosity while leaving intact the other desirable printhead cleaning characteristics of glycerin. The cleaning solvent formulations of the present invention provide optimal viscosity, vapor pressure, solubility, hygroscopicity, and surface tension to ensure acceptable cleaning of the printhead regardless of the operating environment.

BRIEF DESCRIPTION OF THE SEVERAL VIEWS OF THE DRAWING

While the specification concludes with claims particularly pointing out and distinctly claiming that which is regarded as the present invention, the present invention can be more readily ascertained from the following description of the invention when read in conjunction with the accompanying drawings in which:

DETAILED DESCRIPTION OF THE INVENTION

Figure 1:
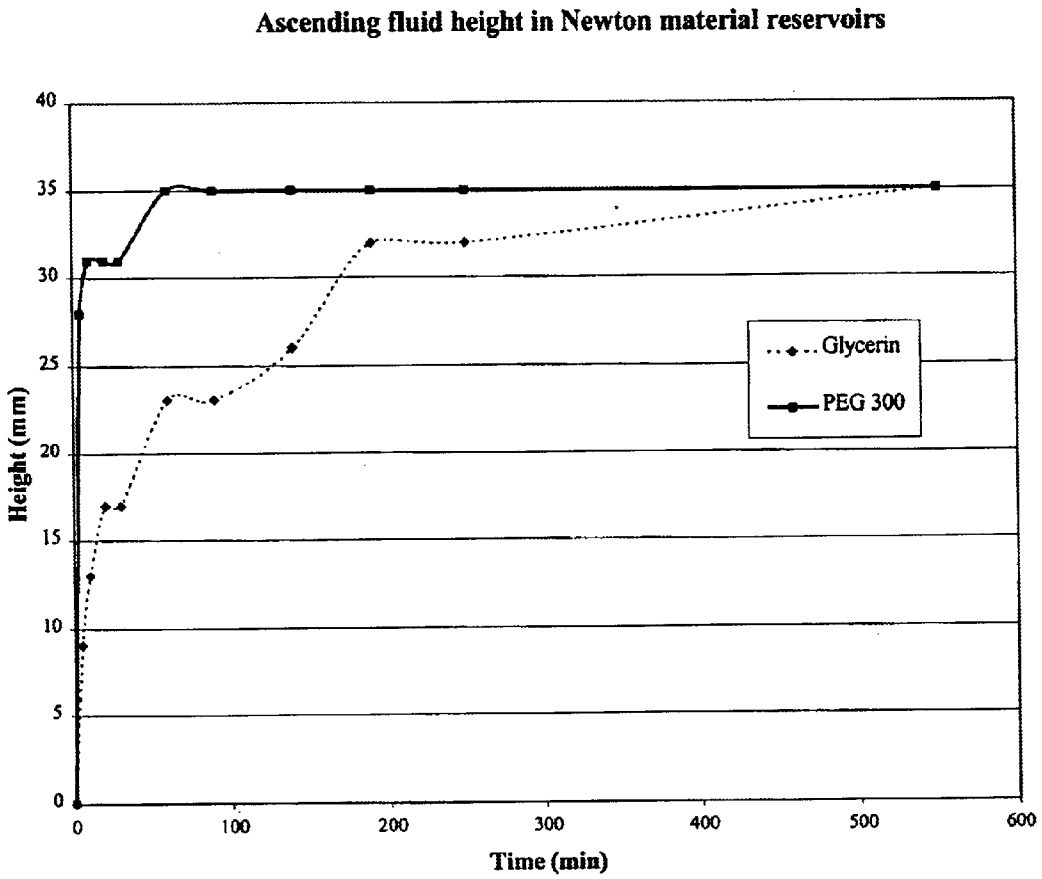
FIG. 1 represents the ascending fluid height as a function of time for glycerin and PEG 300.

The present invention is directed to cleaning solvents for use with ink-jet printhead servicing systems. More specifically, a cleaning solvent for use in a wet-wiping printhead servicing system is disclosed. The cleaning solvent enables the effective cleaning of the printhead such that high quality printing is maintained. The cleaning solvents of the present invention ensure optimal viscosity, vapor pressure, solubility, hygroscopicity, and surface tension to maintain acceptable cleaning of the printhead regardless of the operating environmental conditions.

The specific cleaning solvent disclosed comprises a mixture of glycerin and 1,3-propanediol. The cleaning solvent preferably contains from about 1 wt % to about 99 wt % 1,3-propanediol. More preferably, the cleaning solvent contains from about 30 wt % to about 70 wt % 1,3-propanediol, with a concentration of from about 40 wt % to about 60 wt % 1,3-propanediol being the most preferred. Also in a preferred embodiment, the weight percent of glycerin in the cleaning solvent is in a range of from about 40 wt % to 60 wt %. Surprisingly, it has been found that the addition of 1,3-propanediol decreases the viscosity of glycerin while advantageously maintaining other properties of glycerin that facilitate effective cleaning of the printhead. While water is not added to the preferred formulation, the glycerin and 1,3-propanediol may absorb water from the environment and additional water may be added to further adjust the properties of the cleaning solvent.

Along with the principal components, the cleaning solvent can also comprise surfactants and/or biocides to provide desirable characteristics to the cleaning solvent.

The cleaning solvents of the present invention optionally comprise 0 to about 0.5 wt % biocide. More preferably, the cleaning solvents comprise from about 0.1 to about 0.3 wt % biocide, with a concentration from about 0.2 to about 0.3 wt % being the most preferred. Any of the biocides commonly employed in ink-jet inks may be employed in the practice of the invention. Suitable biocides include, for example, Nuosept 95, available from Huls America (Piscataway, N.J.); Proxel GXL, available from Zeneca (Wilmington, Del.); and glutaraldehyde, available from Union Carbide Company (Bound Brook, N.J.) under the trade designation Ucarcide 250.

The invention is further explained by the use of the following illustrative examples:

EXAMPLES

Example I

Glycerol as a Replacement for PEG

Printhead Servicing Test: Comparison of Glycerin and PEG at 35% RH

A 300 molecular weight polyethylene glycol (PEG 300) had been widely used in ink-jet printer systems as a solvent to assist in cleaning the printhead. PEG 300 is an efficient solvent for this purpose, but is known to degrade the printhead structure by dissolving it and allowing ink to penetrate into the circuitry. The ink penetration creates a failure mode referred to as outside ink shorts (OIS). As OIS is a leading cause of printhead failure, a replacement cleaning solvent that would retain or improve servicing effectiveness, as well as significantly reduce OIS is desired.

In a printhead servicing test, the printhead was triggered to eject ink and subsequently serviced by wiping the printhead. The relative performance of a glycerin-based cleaning solution was analyzed by comparison to the performance of a PEG-based cleaning solvent. A number of variable parameters were chosen to characterize the robustness of the cleaning solvents, such as: generating millions of drops between servicing events, since an increase in the number of drops increases the difficulty of cleaning the printhead; dry-to-wet ratio or the number of dry wipes (wipes without cleaning solvent) performed for every wet wipe (wipes with cleaning solvent), since fewer wet wipes increases the difficulty of cleaning the printhead; and volume of cleaning solvent applied to the printhead, which is increased by increasing the wick width. The effectiveness of the cleaning solvent was qualitatively characterized by observance of ink buildup on the printhead as compared to the performance of PEG, and by the number of nozzles blocked throughout the testing life of the printhead as compared to the performance of PEG.

The performances of glycerin- and PEG-based cleaning fluids were compared at 35% relative humidity (RH). The printhead was triggered with 100 million black drops and 150 million color drops between servicing events then serviced by wiping the printhead with a dry-to-wet ratio of 10:1 with a 5 mm wide wick. In these conditions, glycerin performed similarly to PEG.

Example II

Printhead Servicing Test: Comparison of Glycerin and PEG Under Different Printing Conditions Since glycerin performed similar to PEG, different cleaning conditions were tested using the test described in Example I. The performances of glycerin and PEG were compared at 35% RH. Unlike the test of Example I, the printhead was triggered with 120 million black drops and 200 million color drops between servicing events then serviced by wiping the printhead with a dry-to-wet ratio of 10:1 with a 5 mm wide wick. With this combination of variables, both glycerin and PEG maintained a steady state level of nozzles out. Glycerin performed similarly to PEG, indicating that glycerol was an adequate substitute for PEG as a cleaning solvent under harsh printing conditions.

Example III

Printhead Servicing Test: Glycerin Performance at Low RH

The performance of glycerin was analyzed in a cold, dry environment, specifically at 15° C. and 20% RH, using the same procedure as described in the test of Example I. A cold, dry environment is the most problematic environment for glycerin, because glycerin becomes increasingly viscous as both humidity and temperature decrease. The printhead was triggered with 20 million black drops and 50 million color drops between servicing events, and was then serviced by wiping the printhead with a dry to wet ratio of 10:1 or 5:1 with a 2.5 mm, 5 mm, or 10.6 mm wide wick. In these conditions, wider wicks and a lower dry-to-wet ratio resulted in a reduction of ink buildup on the printhead. Hence, glycerin exhibits improved performance as the dry-to-wet ratio is reduced and wick width is increased, indicating that more glycerin is required to adequately clean the printhead in cold, dry environments.

Example IV

Printhead Servicing Test: Comparison of Glycerin and PEG at Low RH

The performance of glycerin was compared to PEG in a cold, dry environment, specifically 15° C. and 20% relative humidity, using the same procedure as described in the test of Example I. The printhead was triggered with 30, 35, or 50 million color drops between servicing events, and was then serviced by wiping the printhead with a 10.6 mm wide wick. While the glycerin-treated printhead had a similar intermittent number of nozzles out as the PEG-treated printhead, the glycerin treatment resulted in fewer nozzle out events. Thus, glycerin performed better at this temperature and humidity than PEG.

After conducting the various cleaning solvent investigations discussed above, glycerin was selected as a possible replacement for PEG 300. However, due to the different physical and chemical characteristics of glycerin, various tests to evaluate key characteristics of glycerin were conducted, as described hereafter.

Example V

Capillary Pressure Measurements

Ascending capillary height obtainable in reservoir materials for glycerol versus PEG 300 was tested to determine the amount of cleaning solvent that the solvent reservoir material could support without drooling the solvent back out. To test the differences between glycerol and PEG 300, several solvent reservoirs were cut to lay more evenly on top of one another. The reservoirs were stacked on top of each other to mimic their placement in a printer and to simulate the orientation of the fibers in the reservoirs. A stack of reservoirs was then placed into a dish filled with either glycerin or PEG 300. Measurements of the solvent height in the reservoir stack were taken until the saturation height did not change. The height of saturated solvent was measured as the ascending capillary pressure of the reservoir material.

Several reservoirs were tested for their capillary pressures. Three different densities of a bonded nylon/polyester 80/20 hydrophilic fiber reservoir were tested. The resulting plots for ascending solvent height as a function of time for glycerin and PEG 300 in bonded nylon reservoirs are illustrated in FIG. 1. As shown in the graph of FIG. 1, the PEG 300 sample traveled up the reservoir at a faster rate than the glycerin sample. Although differences in surface tension, density, and contact angle of the two solvents resulted in the difference in rate of increase of solvent height, both solvents attained the same height of approximately 35 mm.

Example VI

Pick Amount Testing

A pick amount test was conducted to correlate capillary pressure of the reservoir material with the amount picked onto the wiper. Tests were run by injecting solvent dispense systems with an 88.5% glycerin and 11.5% water mixture to approximate the RH of the office environment, which was 35% RH. Because glycerin is very hygroscopic and is known to absorb moisture out of the air depending on the RH of the environment, the solvent was premixed to prevent additional absorption or release of water to reach an equilibrium state. Results of these tests are shown in Table I.

TABLE I

Pick testing of 88.5% glycerol solution
Bonded nylon fiber reservoirs

Average of all values 0.00061
St. Dev. of all values 0.00008

Units in gram

| | Run 1 | Run 2 | Run 3 | Run 4 | Run 5 | Average | St. Dev. |
|---|---|---|---|---|---|---|---|
| Bonnet 1 | 0.00064 | 0.00067 | 0.00071 | 0.00059 | 0.00064 | 0.00065 | 0.00004 |
| Bon net 2 | 0.00047 | 0.00048 | 0.00058 | 0.00058 | 0.00070 | 0.00056 | 0.00009 |
| Bonnet 3 | 0.00060 | 0.00068 | 0.00058 | 0.00052 | 0.00068 | 0.00061 | 0.00007 |

As shown in Table I, the pick testing results averaged 0.000061 g per wiper assembly. The desirable target was about 0.00060 g to 0.00080 g per assembly.

Example VII

Pick Amount Testing in Dry Environment

To further analyze the cleaning solvent characteristics of pure glycerin, pick amounts were evaluated in dry conditions. Due to the high viscosity of pure glycerin, the most difficult picking condition is a dry environment where the glycerin cannot absorb water. To simulate a dry environment, pure glycerin was injected into the solvent dispense system.

The pure glycerin pick test was conducted using the same procedure as described in Example VI. As shown in Table II, the pick testing results averaged 0.00110 g per wiper assembly. The larger pick weight as compared to the 35% RH glycerin solvent test value of 0.00061 g is believed to be due to the density difference between the 35% RH glycerin solution and pure glycerin.

TABLE II

Pure glycerol pick testing
Bonded nylon fiber reservoirs

Units in gram

| | Run 1 | Run 2 | Run 3 | Run 4 | Run 5 | Average | St. Dev. |
|---|---|---|---|---|---|---|---|
| Pick amount | 0.00101 | 0.00109 | 0.00113 | 0.00113 | 0.00114 | 0.00110 | 0.00005 |

The tests demonstrate the ability to pick pure glycerin from the dispense system, which results in a large pick volume, which will deplete the source of solvent sooner than desired (e.g., when compared to the results of Table I).

Example VIII

Solvent Additive Research

Due to the high viscosity of pure glycerin and the probability of printers working in dry, cool environments, a search for potential additives to reduce viscosity of glycerin was initiated. Ideal additives would reduce viscosity of the glycerin while minimizing changes in the surface tension, vapor pressure, hygroscopicity, and solubility of the glycerin based solvent as compared to pure glycerin.

The following properties are determinative of an effective cleaning solvent: fluid viscosity, vapor pressure, solubility parameters, hygroscopicity, and surface tension. A lower viscosity was desired to increase the flow onto the wiper and thereby increase the pick amount. Vapor pressure affects volatilization out of the reservoir or off the printhead during application. The solubility parameters determine compatibility with printer parts, with the Hildebrand solubility parameter being the main solubility parameter investigated. Finally, it was desirable to keep the hygroscopicity and surface tension as close to constant as possible.

Additives with functional groups likely to be miscible with glycerin were identified to assure that the additive would mix with glycerin in solution. Once functional groups were identified, the additive search was narrowed to certain families of chemical compounds. Specific compounds were selected using characteristics mentioned above.

Based on these criteria, the polyhydric alcohol family was selected. Specifically, the three compounds with the most desirable characteristics for an additive were:

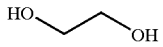

1,2-Propanediol
a.k.a. Propylene glycol

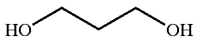

1,3-Propanediol
a.k.a. Trimethylene glycol

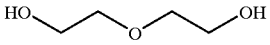

Diethylene glycol

These structures were compared to the structure of glycerin, which is shown below for reference:

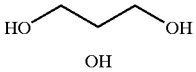

In comparing 1,2-propanediol to the structural isomer 1,3-propanediol, it was noted that 1,3-propanediol is more similar in structure to glycerin than 1,2-propanediol. Moreover, the chemical properties of 1,3-propanediol are more similar to glycerine than 1,2-propanediol. Based on the foregoing analysis, 1,3-propanediol was selected as the most desirable compound to add to glycerin for purposes of lowering viscosity of the glycerin while still preserving other favorable cleaning solvent properties of glycerin.

Example IX

Glycerin and 1,3-propanediol Cleaning Solvent 1,3-propanediol and glycerin are mixed to decrease the viscosity of the cleaning solvent. The addition of this structurally similar compound to glycerin will decrease the viscosity such that less of the cleaning solvent will be necessary to achieve optimal performance in cold, dry environments, yet will maintain the other advantageous cleaning solvent characteristics of glycerin, such as vapor pressure, hygroscopicity, solubility parameters, and surface tension. As the determinative cleaning solvent characteristics of glycerin are maintained, the cleaning solvent is comparable to pure glycerin and will act as an effective PEG substitute.

What is claimed is:

1. A cleaning solvent for use in an ink-jet printer, comprising:

a polyhydric alcohol comprising from about 30 to about 70 wt % of the cleaning solvent; and glycerin, wherein the ratio by weight of glycerin to said polyhydric alcohol is in the range of about 40 to about 60.

2. The cleaning solvent of claim 1, wherein said polyhydric alcohol is selected from the group 1,2-propanediol, diethylene glycol and 1,3-propanediol.

3. The cleaning solvent of claim 2, wherein said polyhydric alcohol is 1,3-propanediol.

4. The cleaning solvent of claim 3, further comprising water.

5. The cleaning solvent of claim 1, wherein said polyhydrid alcohol comprises about 40 to about 60 wt % of the cleaning solvent.

6. The cleaning solvent of claim 1 further comprising from about 0.01 to about 0.5% of a biocide.

7. The cleaning solvent of claim 3 further comprising from about 0.01 to about 0.5% of a biocide.

8. A method for ink-jet printhead cleaning, comprising:

providing a cleaning solvent for cleaning said printhead, said cleaning solvent comprising glycerin and a polyhydric alcohol, wherein said polyhydric alcohol and said glycerin comprise greater than 50 wt % of said cleaning solvent;

transferring an amount of said cleaning solvent onto the printhead; and cleaning said printhead with said cleaning solvent.

9. The method of claim 8, wherein said polyhydric alcohol is 1,3-propanediol.

10. The method of claim 9, wherein said 1,3-propanediol comprises from about 1 to about 99 wt % of said cleaning solvent.

11. The method of claim 8, wherein said polyhydric alcohol comprises from about 30 to about 70 wt % of said cleaning solvent.

12. The method of claim 8, wherein said polyhydric alcohol comprises from about 40 to about 60 wt % of the cleaning solvent.

13. The method of claim 8, wherein said cleaning solvent further comprises from about 0.01 to about 0.5% of a biocide.

14. The method of claim 9, wherein said cleaning solvent further comprises from about 0.01 to about 0.5% of a biocide.

15. The method of claim 8, wherein cleaning said printhead comprises wiping debris from said printhead.

16. A cleaning solvent for use in an ink-jet printer, consisting essentially of:

glycerin;

1,3-propanediol; and at least one component which acts as a biocide.

17. The cleaning solvent of claim 16, wherein said 1,3-propanediol comprises from about 30 to about 70 wt % of said cleaning solvent.

18. The cleaning solvent of claim 16, further comprising water.

19. The cleaning solvent of claim 16, wherein glycerin is present in a range of from about 40 to about 60 wt %.

20. The cleaning solvent of claim 16, wherein said biocide comprises from about 0.01 to about 0.5% of a said cleaning solvent.

* * * * *